US010921059B2

(12) United States Patent
Newland, III et al.

(10) Patent No.: US 10,921,059 B2
(45) Date of Patent: Feb. 16, 2021

(54) METHOD AND APPARATUS FOR A DRYER SYSTEM

(71) Applicant: ILLINOIS TOOL WORKS INC., Glenview, IL (US)

(72) Inventors: Jeem Edward Newland, III, Springboro, OH (US); William Mark Feldmann, Cincinnati, OH (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 16/151,949

(22) Filed: Oct. 4, 2018

(65) Prior Publication Data

US 2020/0109897 A1 Apr. 9, 2020

(51) Int. Cl.
*F26B 15/12* (2006.01)
*F26B 21/00* (2006.01)

(52) U.S. Cl.
CPC ..... *F26B 15/12* (2013.01); *F26B 21/004* (2013.01)

(58) Field of Classification Search
CPC .. F26B 3/04; F26B 15/12; F26B 15/14; F26B 21/004; F26B 23/04
USPC ..... 34/500
See application file for complete search history.

(56) References Cited

U.S. PATENT DOCUMENTS 3,309,835 A * 3/1967 Peppler ..... B65B 53/063 53/442
4,053,993 A 10/1977 Schregenberger
4,270,702 A * 6/1981 Nicholson ..... B05C 11/06 118/63
4,292,745 A * 10/1981 Caratsch ..... F26B 13/104 226/196.1
4,336,279 A 6/1982 Metzger
4,662,085 A 5/1987 Russo
4,693,014 A * 9/1987 Caflisch ..... G03D 15/027 34/464
4,852,271 A 8/1989 Heckman
5,005,250 A * 4/1991 Trautmann ..... B08B 11/04 15/309.2
5,022,167 A * 6/1991 Nakamura ..... F26B 13/10 34/655
5,353,520 A 10/1994 Gouge
5,471,764 A 12/1995 Krueger
5,494,529 A * 2/1996 Ciccarelli ..... B08B 3/022 134/15
5,755,043 A * 5/1998 Belanger ..... B60S 3/002 15/312.1

(Continued)

FOREIGN PATENT DOCUMENTS

CA 2776729 A1 * 11/2012 ..... F26B 21/004
EP 1298488 A3 * 4/2003 ..... G03D 15/027

(Continued)

OTHER PUBLICATIONS

Int'l Search Report and Written Opinion Appln No. PCT/US2019/053873 dated Dec. 6, 2019 (12 pgs).

*Primary Examiner* — Stephen M Gravini
(74) *Attorney, Agent, or Firm* — McAndrews, Held & Malloy, Ltd.

(57) ABSTRACT

Provided is a device for drying objects that are, for example, moving on a conveyor belt or assembly line. The objects may be container such as, for example, empty or filled can, empty or filled bottles, or non-container objects.

19 Claims, 8 Drawing Sheets

(56) References Cited

U.S. PATENT DOCUMENTS

| | | | | | |
|---|---|---|---|---|---|
| 6,134,811 | A * | 10/2000 | Berger | B08B 5/026 | 34/618 |
| 6,231,001 | B1 * | 5/2001 | Kramer | B65H 23/24 | 242/615.11 |
| 7,563,322 | B2 * | 7/2009 | Loth | B05C 11/06 | 118/63 |
| 7,997,003 | B2 * | 8/2011 | Dotzler | F26B 13/101 | 223/51 |
| 8,074,372 | B2 * | 12/2011 | Pucciani | F26B 21/004 | 34/222 |
| 8,382,013 | B2 * | 2/2013 | Pucciani | B05B 1/005 | 239/597 |
| 8,528,232 | B1 * | 9/2013 | Ennis | F26B 21/004 | 134/12 |
| 8,613,147 | B2 * | 12/2013 | McElroy | F26B 21/004 | 15/30 |
| 2003/0061727 | A1 * | 4/2003 | Wells | G03D 15/02 | 34/418 |
| 2003/0145481 | A1 * | 8/2003 | Zagar | F26B 13/104 | 34/83 |
| 2014/0199935 | A1 * | 7/2014 | Pucciani | F26B 15/18 | 454/305 |
| 2014/0259731 | A1 | 9/2014 | Zea | | |
| 2018/0222178 | A1 * | 8/2018 | Boland | B41F 23/0413 | |

FOREIGN PATENT DOCUMENTS

| | | | | |
|---|---|---|---|---|
| EP | 2946159 | B1 * | 5/2019 | F26B 21/004 |
| JP | 2003130544 | A * | 5/2003 | G03D 15/02 |
| WO | WO-2014113274 | A3 * | 11/2014 | F26B 21/004 |

* cited by examiner

METHOD AND APPARATUS FOR A DRYER SYSTEM

BACKGROUND

The present disclosure relates to air delivery devices and, more particularly, to a method and apparatus for a dryer system.

Limitations and disadvantages of conventional systems for drying containers on a factory line will become apparent to one of skill in the art, through comparison of such approaches with some aspects of the present method and system set forth in the remainder of this disclosure with reference to the drawings.

SUMMARY

Methods and systems are provided for a dryer system, substantially as illustrated by and described in connection with at least one of the figures, as set forth more completely in the claims.

BRIEF DESCRIPTION OF THE DRAWINGS

These and/or other aspects will become apparent and more readily appreciated from the following description of some example embodiments, taken in conjunction with the accompanying drawings.

The drawings are not necessarily to scale. Where appropriate, similar or identical reference numbers are used to identify similar or identical elements.

DETAILED DESCRIPTION

A dryer system is used to dry various devices that are, for example, moving on an assembly line, conveyor belt, etc.

For example, the dryer system can be used to dry containers for a wide range of food, beverage, and commercial packagers. The dryer system provides an energy efficient removal of excess water for, but not be limited to, filling/packaging lines in the beverage, brewery, food, pet food, aerosol, and industrial segments. While the term "water" is used for ease of description, it should be understood that the removal process may also be used for other liquids.

Figure 1:
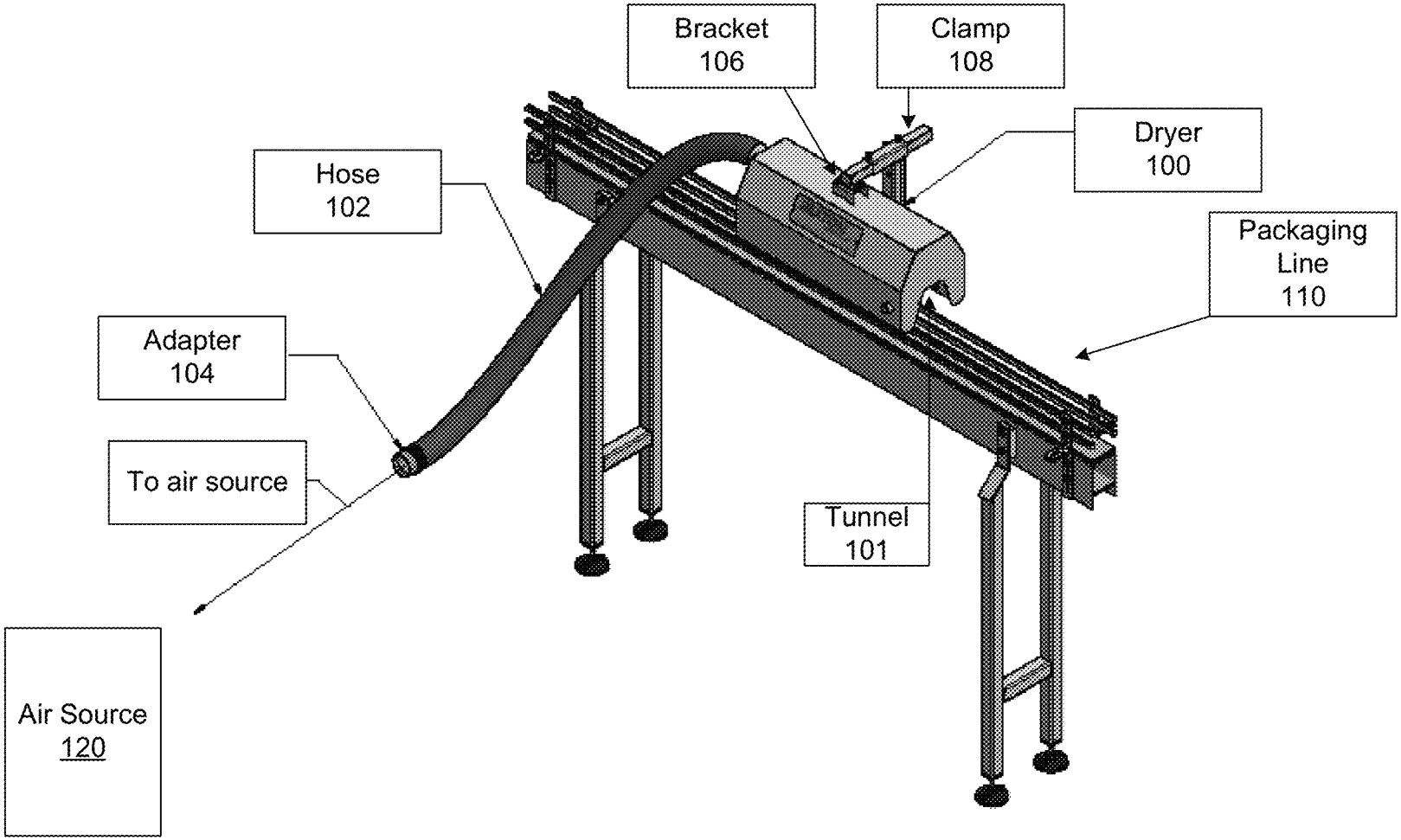
FIG. 1 is a perspective view of an example dryer system for use on a packaging line, in accordance with aspects of the disclosure.

Shown in FIG. 1, there is a dryer system 100 for use with a packaging line 110, where the packaging line 110 may be used to move, for example, filled cans for further processing. The further processing may include, for example, applying labels and/or printing text/graphics on the cans. However, as the cans may be washed with warm water to remove any residues on the cans, in many applications the water must be removed in order to apply labels to the cans and/or print text/graphics on the cans. The example dryer system 100 is configured to remove water from such cans, containers, and/or other objects.

For example, the dryer system 100 is installed on the packaging line 110 using a clamp 108, which is coupled to the packaging line 110, to couple to the bracket 106 of the dryer system 100. The hose 102 is connected to the dryer system 100 and to an air source 120, where the air source 120 provides air to dry the cans on the packaging line 110. In the example of FIG. 1, the cans will come from the left side of the packaging line 110, proceed through the tunnel 101 of the dryer system 100, and travel to the right side of the packaging line 110. It should be noted that the packaging line 110 may be a portion of a line for filling cans and processing the filled cans to a finished state for shipping.

While a particular method of fastening the dryer system 100 to the packaging line 110 is shown in FIG. 1, other techniques may be used. For example, a U-shaped bracket may be used to go under and around the packaging line 110, and the arms of the U-shaped bracket may be fastened to the sides of the dryer system 100. The fastening may be, for example, screws, bolts, wingnuts, clamping levers, insertion of the arms into receptacles that removably or fixedly hold the arms that snap in place, or any method suitable for clamping a device in place.

Another example for clamping the dryer system 100 to the packaging line 110 may involve ears that extend down from each side of the dryer system 100. The ears can be fastened to the packaging line 110. The packaging line 110 may have bolt holes, screw holes, brackets, receptacles for receiving the ears, etc. that may be used to fasten the dryer system 100 to the packaging line 110. Accordingly, as can be seen, any of multiple methods that are suitable for fastening one device to another can be used.

A dryer system 100 may serve multiple packaging lines that may be parallel to each other. For example, when two packaging lines are placed relatively close to each other, a single dryer with multiple tunnels 101 (not shown) may be fastened to the packaging lines such that each tunnel 101 may straddle a packaging line. This type of dryer may have a single hose 102 or multiple hoses 102 for delivering air to the dryer system 100. Accordingly, a single dryer system 100 may serve multiple packaging lines, and a single air source 120 may be used for drying the multiple packaging lines 110. When the dryer system 100 has multiple hoses 102, those hoses 102 can be connected to one or more air sources 120.

Also, while the dryer system 100 and the packaging line 110 were described as processing filled cans for ease of description, various aspects of the disclosure can apply to any container or object that needs to remove water from at least its outer surface(s). For example, filled bottles may be on the packaging line 110 and water removed from its exterior surface by the dryer system 100. Additionally, an interior surface and/or exterior surface of an object or unfilled container may be dried by the dryer system 100 if such processing is needed, where the dryer system 100 may be appropriately configured for the shape and/or surface to be dried.

Figure 2:
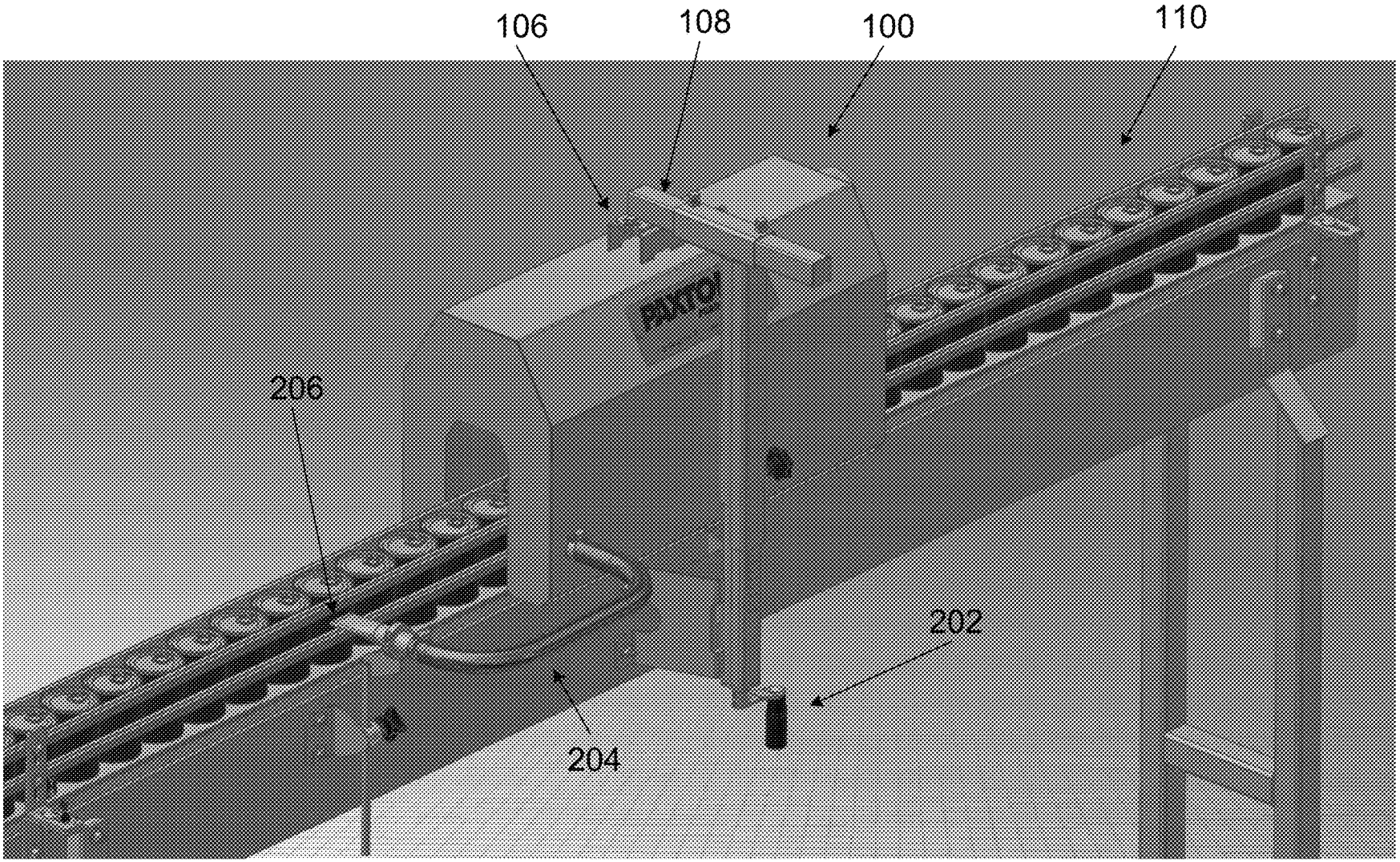
FIG. 2 is a perspective view of the example dryer system mounted for use on a packaging line, in accordance with aspects of the disclosure.

Referring to FIG. 2, there is shown the example dryer system 100 of FIG. 1 clamped on to the packaging line 110. As can be seen, the clamp 108 pushes down on the bracket 106 to keep the dryer system 100 firmly coupled to the packaging line 110. The handle 202 may be turned to move the clamp 108 up or down to couple or uncouple the dryer system 100 to the packaging line 110. Accordingly, the handle 202 is suitable for different dimensions of the packaging line 110 and/or the dryer system 100.

An air hose 204 may be coupled to the dryer system 100. The air coming out of the nozzle 206 attached to the air hose 204 can be used, for example, to remove cans that are not filled when the dryer system 100 is used to dry filled cans. That is, as empty cans are lighter than filled cans, the air from the nozzle 206 can knock the empty cans off the packaging line 110 while leaving the filled cans on the packaging line 110. The air hose 204 may be used optionally as needed.

Various aspects of the disclosure may have multiple air hoses 204 and/or multiple nozzles 206 for each air hose 204.

Figure 3A:
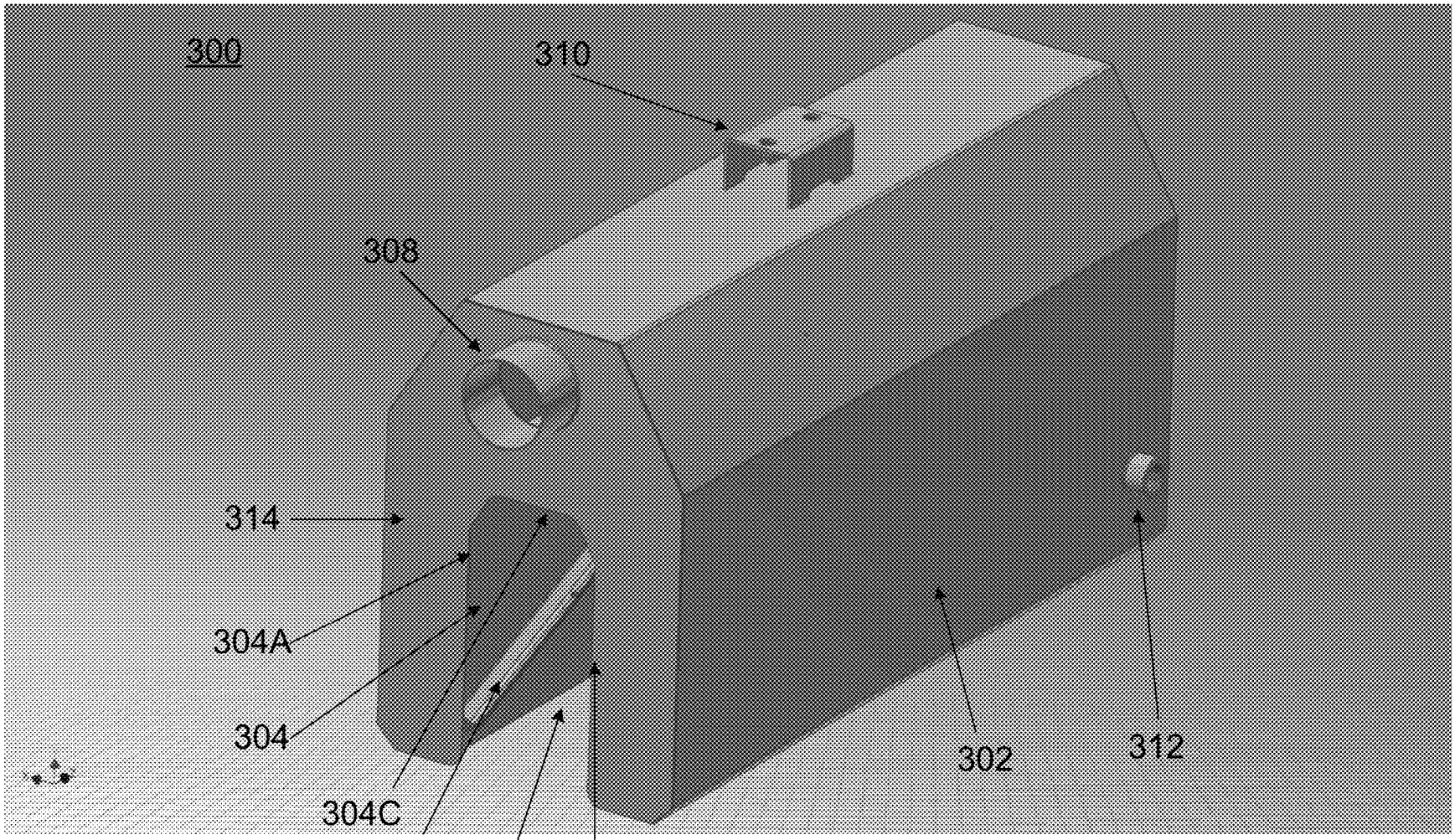
FIG. 3A is a more detailed view of the example dryer system of FIG. 2, in accordance with aspects of the disclosure.

FIG. 3A is a more detailed view of the example dryer system of FIG. 2. Referring to FIG. 3A, there is shown an example dryer system 300, which is similar to the dryer system 100. The dryer system 300 comprises a housing comprising of an outer surface 302 and an inner surface 304. The inner surface 304 comprises a first wall 304A (for example, a left wall of the inner surface 304), a second wall 304B (for example, a right wall of the inner surface 304) opposite the first wall 304A, and a ceiling 304C connecting the first wall 304A and the second wall 304B.

As can be seen in FIG. 3A, there is an air knife 306 on the first wall 304A. Although not shown in FIG. 3A, there is also a corresponding air knife 320 (shown in FIG. 3B) on the second wall 304B that is positionally aligned with the air knife 306. That is, the air knife 306 is parallel to the air knife 320, and the lowest ends of the air knives 306 and 320 are at substantially the same height from the bottom of the dryer system 300, and the highest ends of the air knives 306 and 320 are at substantially the same height from the bottom of the dryer system 300.

An air knife may comprise a linear or non-linear air conduit. The air knife may have uniform structure in one dimension, or the structure may vary along a dimension. For example, the air knife may increase in width along its length. The air knife may have a single slit along a majority of a length of the air knife, or the air knife may have multiple openings. The single slit may have different shapes along its length to direct blades of air to specific directions. The multiple openings may all be similar or at least one opening may be a different shape than others to direct blades of air or jets of air to specific directions. The shape of each opening in an air knife may depend on the usage application of the dryer system 300.

The dryer system 300 also comprises an air inlet 308 that may be coupled to, for example, the hose 102 to receive air from an air source 120, as well as the bracket 310. The air source 120 may be any device suitable for providing air to the dryer system 300 such as, for example, a fan, an air compressor, air tank, etc. The bracket 310 is similar to the bracket 106 described with respect to FIG. 1 and FIG. 2. The air hose 204 (FIG. 2) may couple to the air outlet 312. The dryer system 300 may also have end a first end wall 314 and a second end wall 316 (shown in FIG. 3B) opposite the first end wall 314. The air inlet 308 may be placed on the first end wall 314 or the second end wall 316, or any suitable position of the dryer system 300. Also, while the air outlet 312 is positioned at a specific location of the dryer system 300, various aspects of the disclosure may place the air outlet 312 at different locations. When the air outlet 312 is not used, it may be closed off using any of various devices (not shown) such as, for example, a valve cock, a cap, a plug, etc. Some aspects of the disclosure may permanently close off the air outlet 312, while other aspects of the disclosure may provide the air outlet 312 to be opened. The dryer system 300 may also comprise a pressure relief valve (not shown) to avoid excessive air pressure from the air source 120. The pressure release valve may be a part of the air outlet 312 or located at another position. Accordingly, various aspects of the disclosure may provide a single air outlet 312 or multiple air outlets 312.

Various aspects of the disclosure may form the inner surface 304 and the outer surface 302 such that one or both of the inner surface 304 or outer surface 302 are formed to meet without a need for one or both of the first end wall 314 or the second end wall 316. Where the inner surface 304 and the outer surface 302 meet may then be formed for the air inlet 308, if the air inlet 108 is to be placed at an end portion of the dryer system 300. The air inlet 308 may also be placed in different locations of the dryer system 300 such as, for example, on a side or top of the outer surface 302.

Figure 3B:
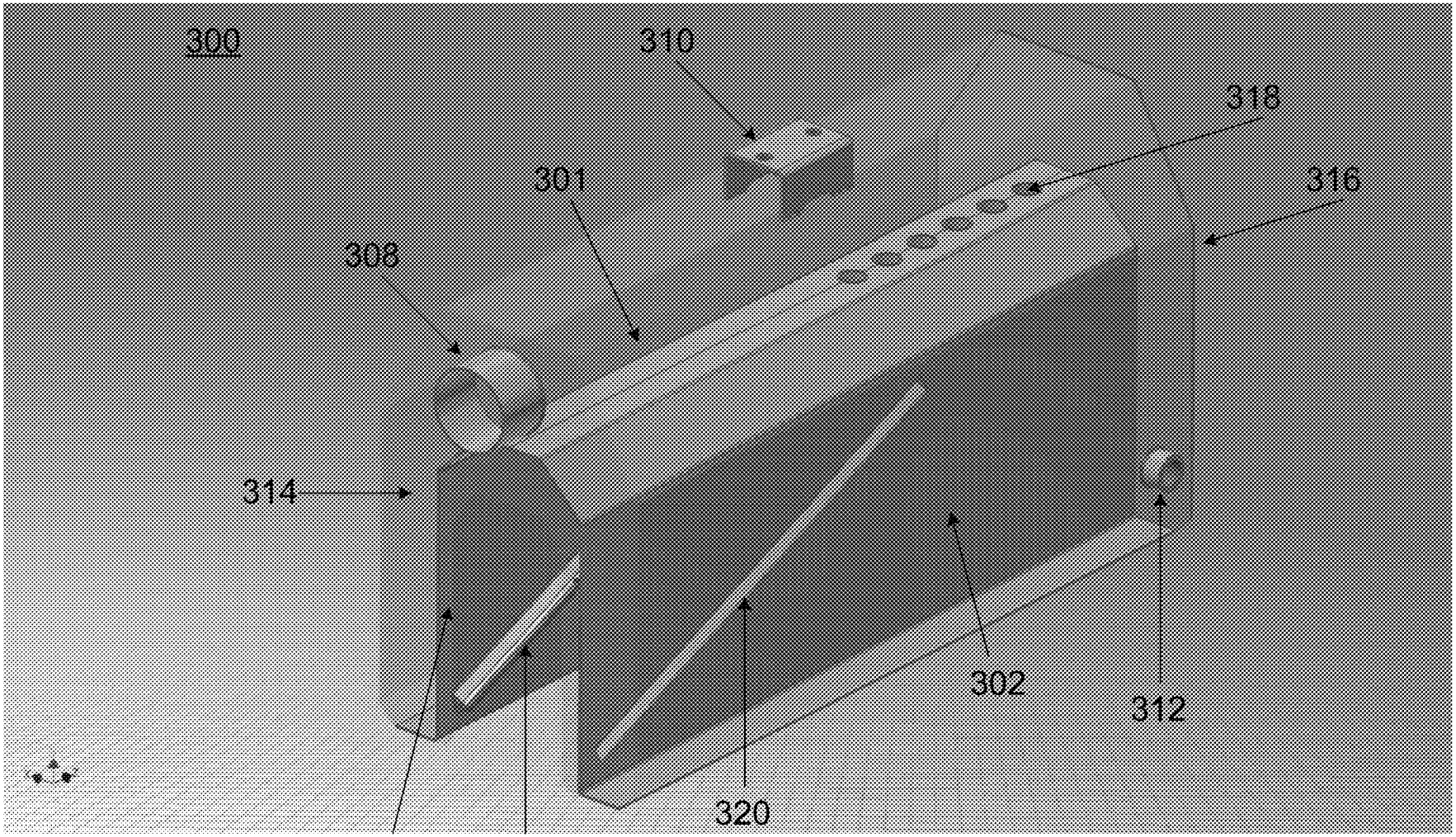
FIG. 3B is a drawing with an outer surface of the example dryer system shown as being transparent for illustration purposes, in accordance with aspects of the disclosure.

FIG. 3B is a drawing with an outer surface of the example dryer system shown as being transparent for illustration purposes. Referring to FIG. 3B, there is shown the dryer system 300 of FIG. 3A that further shows the second end wall 316, a plurality of openings 318, and the air knife 320 on the second wall 304B of the inner surface 304.

As shown in FIG. 3B, the outer surface 302, the inner surface 304, the first end wall 314, and the second end wall 316 form a plenum 301, or air cavity, to receive air via the air inlet 308 connected to the air source 120 via the hose 102. It should be noted that while the term "hose" is used for convenience, any suitable air conduit may be used in place of the hose 102. Accordingly, an air conduit such as, for example, a pipe may be used, if appropriate, for the hose 102 or hose 204.

Figure 3C:
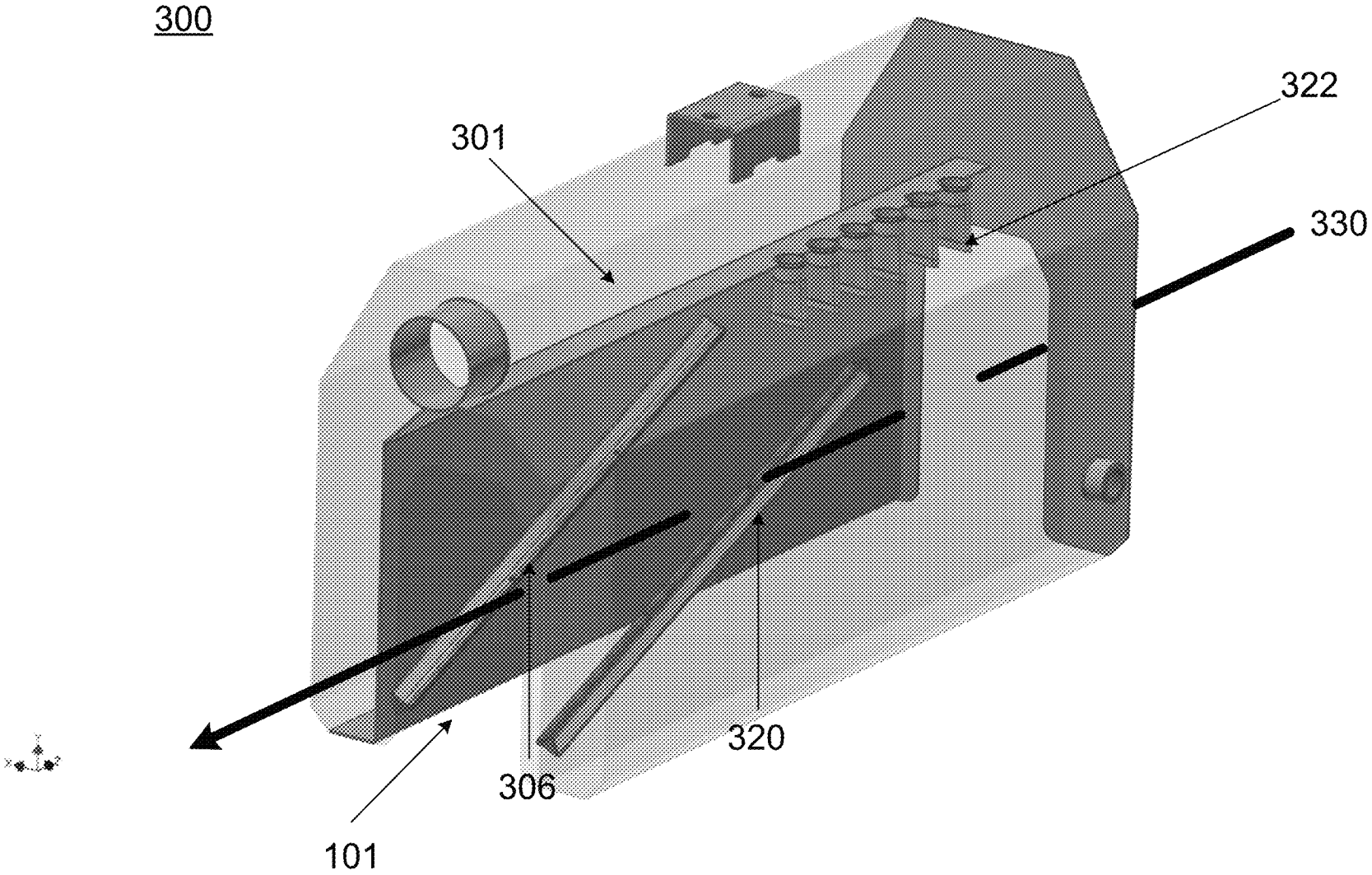
FIG. 3C is a drawing with the outer surface and an inner surface of the example dryer system shown as being transparent for illustration purposes, in accordance with aspects of the disclosure.

The example openings 318 are configured to accept air nozzles 322 (in FIG. 3C). Accordingly, the air nozzles 322 may direct the pressurized air of the plenum 301 to top surfaces of the cans that move through the tunnel 101 to remove water from the top surfaces of the cans. One or more of the nozzles may be, for example, flared air nozzles 322. Air from the plenum 301 may also be directed to the sides of the cans moving through the tunnel 101 of the dryer system 100 via the air knives 306 and 320. Therefore, the dryer system 300 as configured in FIG. 3B may be described as an air manifold with air knives 306 and 320 and air nozzles 322.

While each of the air knives 306 and 320 is shown as single air knife, various aspects of the disclosure may provide the air knife 306 and/or the air knife 320 as multiple air knives that are arranged to remove water from the side surface(s) of the cans (or other containers, objects, etc.) moving through the tunnel 101 of the dryer system 300. Additionally, while discrete air nozzles 322 are shown, various aspects of the disclosure may use one or more air knives on the ceiling 304C rather than discrete nozzles 322.

Two examples of using air knives coupled to the ceiling 304C are shown in FIG. 3D-FIG. 3H.

Accordingly, it can be seen that the dryer system 300 is engineered to be used as a single unit. Since the air knives 306, 320 and the air nozzles 322 are integrated as a single manifold, rather than having to adjust individual components as for prior products in the market where each component has varying levels of articulation that needs to be fine tuned in order for the device to properly remove moisture from a product, various embodiments of the dryer system 300 fixes the nozzles 322 and the air knives 306, 320 for balanced air delivery without the need to individually adjust them for each different packaging line.

FIG. 3C is a drawing with the outer surface and an inner surface of the example dryer system shown as transparent. Referring to FIG. 3C, an object to be dried follows the path shown by the arrow 330.

The object, which may be a filled can, for example, enters the tunnel 101 of the dryer system 300 at the right side. The air nozzles 322 in a first section in the longitudinal direction of the dryer system 300 delivers air to the top surface of the can. As the can travels through the tunnel 101, the nozzles 322 remove any liquid that may be on top of the can.

After passing under the last nozzle 322, the can travels through the second section in the longitudinal direction of the dryer system 300. The slanted air knives 306, 320 remove any liquid that may be on the "vertical" surface(s) of the can, where the "vertical" surfaces are below the top surface and may be vertical or at some angle to vertical.

After passing the last part of the air knives 306, 320, the can travels out of the tunnel 101, and is ready to be labeled and/or printed.

Figure 3D:
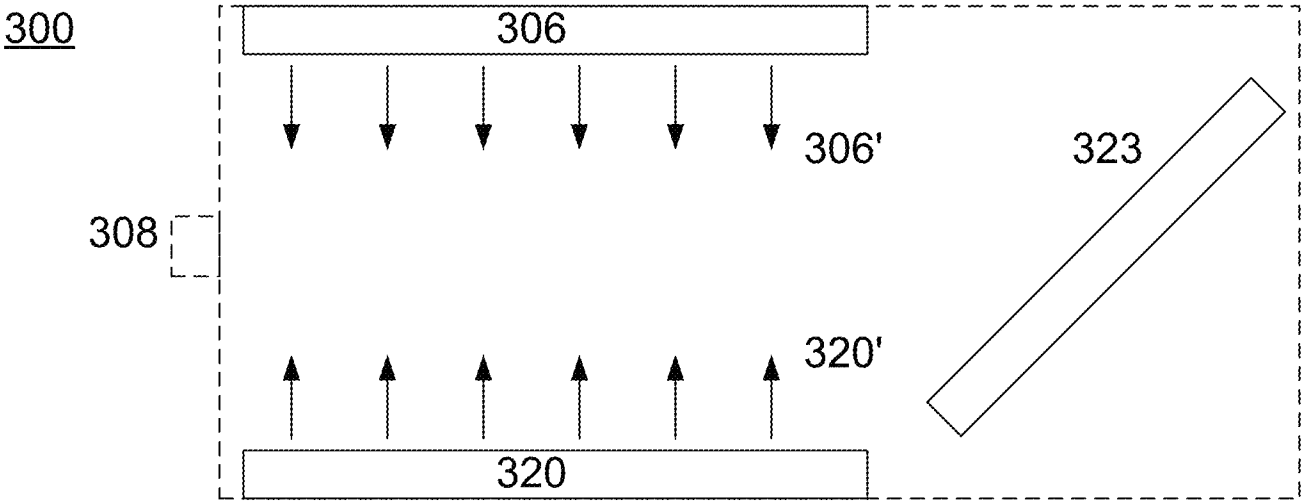
FIG. 3D is a top view of an example air knife configuration of an example dryer system using air knives on the walls and on the ceiling of the dryer system, in accordance with aspects of the disclosure.

FIG. 3D is a top view of an example air knife configuration of an example dryer system using air knives on the walls and on the ceiling of the dryer system. Referring to FIG. 3D, there is shown a top view of air knives 306 and 320 as described for FIGS. 3A-3C. However, the air nozzles 322 are replaced by an air knife 323. There is also shown the air inlet 308.

The arrows 306' and 320' indicate airflow that can be delivered by the air knives 306 and 320. It should be noted that the individual arrows do not indicate individual air streams, but rather the direction of airflow from the air knives 306 and 320.

Additionally, while specific dimensions and placements are shown for the air knives 306, 320, and 323, other embodiments of the dryer system 300 may have different dimensions and/or placements for the air knives 306, 320, and 323. For example, a dryer system 300 may have the air knives 306, 320, and 323 that are longer or shorter than as shown, or the air knife 323 may be placed at an angle different than shown.

Figure 3E:
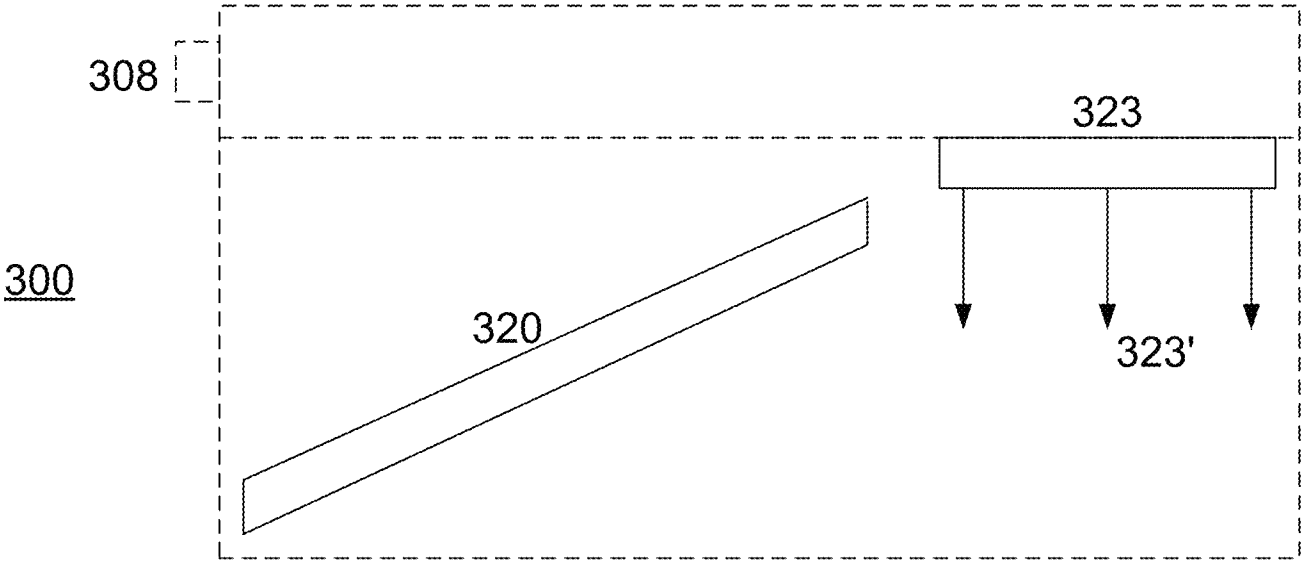
FIG. 3E is a side view of the example air knife configuration of FIG. 3D, in accordance with aspects of the disclosure.

FIG. 3E is a side view of an example air knife configuration of an example dryer system using air knives on the walls and on the ceiling of the dryer system. Referring to FIG. 3E, there is shown a side view of the air knives 320 and 323, where the air knife 306 is hidden by the air knife 320 since they are positionally aligned. There is also shown the air inlet 308.

The arrows 323' indicate airflow that can be delivered by the air knife 323. It should be noted that the individual arrows do not indicate individual air streams, but rather the direction of airflow from the air knife 323.

Additionally, while specific dimensions and placements are shown for the air knives 320 and 323, other embodiments of the dryer system 300 may have different dimensions and/or placements for the air knives 320 and 323. For example, a dryer system 300 may have the air knife 320 (and air knife 306) and 323 that are longer or shorter than as shown, or the air knife 320 (and air knife 306) may be placed at an angle different than shown.

Figure 3F:
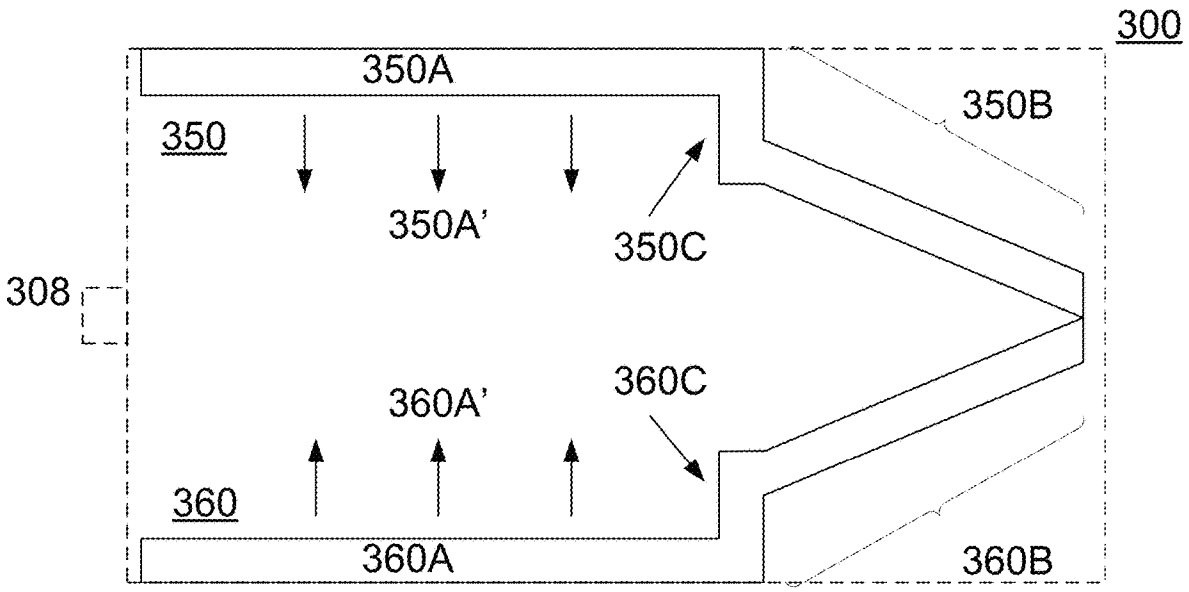
FIG. 3F is a top view of an example air knife configuration of an example dryer system with two air knife structures, in accordance with aspects of the disclosure.
Figure 3G:
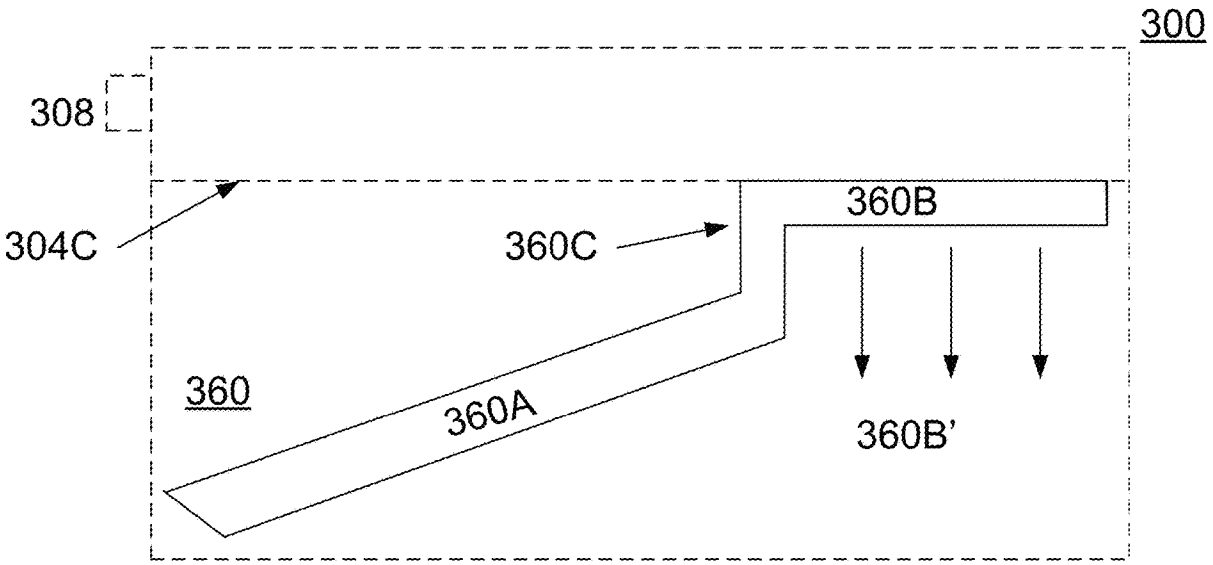
FIG. 3G is a side view of the example air knife configuration of FIG. 3F, in accordance with aspects of the disclosure.

FIGS. 3F and 3G show a top view and a side view, respectively, of an example air knife configuration of an example dryer system with two air knife structures. Referring to FIG. 3F, there are shown a first air knife structure 350 and a second air knife structure 360 that may be used in the dryer system 300 in place of the air knives 306, 320, and the air nozzles 322. There is also shown the air inlet 308. In FIG. 3G, the air knife structure 350 is hidden by the air knife structure 360 since they are positionally aligned.

The first air knife structure 350 may have a first air knife section 350A that is coupled to the first wall 304A and a second air knife section 350B that is coupled to the ceiling 304C. Similarly, the second air knife structure 360 may have a first air knife section 360A that is coupled to the second wall 304B and a second air knife section 360B that is coupled to the ceiling 304C.

The first air knife sections 350A and 360A may deliver air horizontally toward each other and the second air knife sections 350B and 360B may deliver air substantially vertically down to the top surface of a can. As shown in FIG. 3F, the arrows 350A' and 360A' indicate airflow that can be delivered by the air knife sections 350A and 360A. It should be noted that the individual arrows do not indicate individual air streams, but rather the direction of airflow from the air knife sections 350A and 360A.

Similarly, as shown in FIG. 3G, the arrows 360B' indicate airflow that can be delivered by the air knife section 360B (and 350B). It should be noted that the individual arrows do not indicate individual air streams, but rather the direction of airflow from the air knife sections 350B and 360B.

Various aspects of the disclosure may provide an intermediate section 350C that couples the air knife sections 350A and 350B, and, similarly, an intermediate section 360C that couples the air knife sections 360A and 360B. These air knife sections 350C and 360C may also be considered to be either part of the air knife sections 350A and 360A, respectively, or air knife sections 350B and 360B, respectively. As shown in FIG. 3D, the air knife sections 350C and 360C are considered to be part of the air knife sections 350B and 360B, respectively. The air knife sections 350C and 360C may deliver air via a slit or openings in some embodiments, or not deliver air in other embodiments and act as conduits. The direction of air delivery may be design dependent.

Furthermore, the functionality provided by the air knife sections 350B and 360C (and air knife sections 360B and 360C) may be performed by a single piece, whether linear or not, or more than one piece. Various aspects of the disclosure may also provide a configuration where there may be multiple legs of air knife sections coupled to the air knife section 350A and/or 360A, rather than the single leg of air knife section shown by the section 350B (and section 360B). Various aspects of the disclosure may also provide implementations where only one of the air knife structures 350 or 360 may have one or more legs of air knife section(s) that extend on to the ceiling 304C. For example, the air knife structure 350 may comprise the air knife section 350A and air knife section 350B while the air knife structure 360 may only comprise the air knife section 360A, or vice versa. This may be similar to the configuration shown in FIG. 3D, except that the air knife 323 is part of a structure of one of the air knives 306 or 320. The angle of the air knife sections 350B and/or 360B may vary depending on the particular shape of the air knife sections 350B and/or 360B.

The length and/or shape of any particular air knife may depend on, for example, the dimensions of the dryer system 300 and/or the object being dried by the dryer system 300.

Accordingly, while a specific configuration was shown in FIGS. 3F and 3G, it should be understood that various other configurations may be used for the air knife structures 350 and 360 to deliver air to dry an object (such as, for example, a can, a bottle, another type of container, non-container object, etc.) as it passes through the tunnel 101 of the dryer system 300.

FIG. 3G shows a side view of the air knife structure 360 comprising the first air knife section 360A coupled to the second wall 304B and the second air knife section 360B coupled to the ceiling 304C. The air knife structure 350 is hidden by the air knife structure 360 since they are positionally aligned. There is also shown the air inlet 308.

Figure 3H:
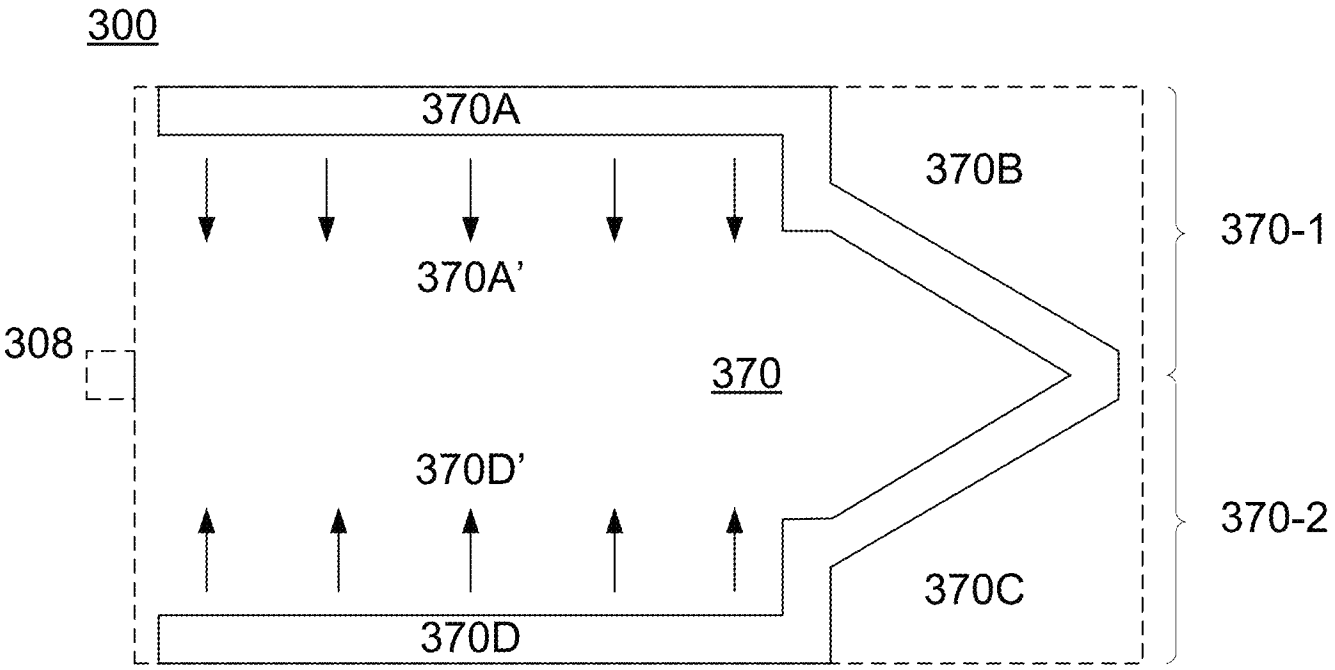
FIG. 3H is a top view of an example air knife configuration of an example dryer system with a single air knife structure, in accordance with aspects of the disclosure.

FIG. 3H is a top view of example dryer system configuration with a single air knife structure. The single air knife structure 370 is similar to the dual air knife structure of FIGS. 3F and 3G where the exception can be seen from the description below. A single air knife structure 370 comprises air knife sections 370-1, 370-2, where the air knife section 370-1 further comprises air knife sections 370A and 370B, and the air knife section 370-2 further comprises air knife sections 370C and 370D. These air knife sections may be similar to those described with respect to FIGS. 3F and 3G, however, the air knife sections 370B and 370C are coupled together so that the air knife 370 is a single air knife structure. Various aspects of the disclosure may disclose aspects of the air knife 370 where air cannot move between the sections 370B to 370C at the intersection of the sections 370B and 370C, while other aspects disclose movement of air between the sections 370B and 370C at the intersection of the sections 370B and 370C. A side view of the air knife structure of FIG. 3H is not shown since it is similar to FIG. 3G.

The delivery of the air by air knives attached to the first wall 304A and the second wall 304B may be substantially horizontally directed toward each other, or the air delivery may be at some angle above or below horizontal toward each other. The delivery of air by the nozzles 322 (or air knife 323 or similar air knife sections described in FIGS. 3F-3H) may be substantially vertically downward.

Similarly as shown FIG. 3F, the air knife sections 370A and 370D may deliver air horizontally toward each other. The arrows 370A' and 370D' indicate airflow that can be delivered by the air knife sections 370A and 370D. It should be noted that the individual arrows do not indicate individual air streams, but rather the direction of airflow from the air knife sections 370A and 370D.

Various aspects of the disclosure provide for the air knives coupled to a wall/ceiling to receive air from the plenum 301. The air may be received via, for example, corresponding openings of the wall/ceiling of the plenum 301 and an air knife. There may be one or more of these corresponding openings for each air knife. The air may be provided to an air knife via any other suitable method such as, for example, using a conduit to connect to the air knife. Various aspects of the disclosure may provide for the air knives and/or air nozzles to be permanently coupled to the dryer system 100 or 300, while other aspects of the disclosure may provide the air knives and/or air nozzles to be removably coupled in place.

An air knife structure may comprise one or more air knives, where each air knife may also be referred to as an air knife section. Therefore, an air knife structure with a single air knife section may be referred to as an air knife. Although these various terms are used to provide more clarity, these terms may also be used interchangeably.

Accordingly, it can be seen that various aspects of the disclosure provide for a dryer system 300 that comprises a plenum 301 configured to receive air from an air source 120 and an air knife structure 370 comprising a first air knife section 370A-1 and a second air knife section 370-2. The first air knife section 370-1 is configured to be coupled to at least a first wall 304A of the plenum 301, and the second air knife section 370-2 is configured to be coupled to at least a second wall 304B of the plenum 301, wherein the second wall 304B is opposite the first wall 304A. The dryer system 300 comprises an air inlet 308 on the plenum 301 configured to receive the air from the air source 120 via an air conduit 102.

The plenum 301 may be substantially upside-down-U shaped, where the plenum 301 comprises an inner surface 304 and an outer surface 302. The inner surface 304 comprises the first wall 304A and the second wall 304B. The inner surface 304 may also comprise a ceiling 304C connecting the first wall 304A and the second wall 304B.

The first air knife section 370-1 comprises a third air knife section 370A configured to be coupled to the first wall 304A and a fourth air knife section 370B configured to be coupled to the ceiling, and the second air knife section 370-2 comprises a fifth air knife section 370D configured to be coupled to the second wall 304B and a sixth air knife section 370C configured to be coupled to the ceiling 304C.

The air knife structure 370 comprises the third air knife section 370A coupled to the fourth air knife section 370B, the fourth air knife section 370B coupled to the sixth air knife section 370C, and the sixth air knife section 370C coupled to the fifth air knife section 370D.

The fourth air knife section 370B and the sixth air knife section 370C are configured to direct air substantially vertically downward. The third air knife section 370A is configured to direct air substantially horizontally in a direction toward the fifth air knife section 370D, and the fifth air knife section 370D is configured to direct air substantially horizontally in a direction toward the third air knife section 370A.

The third air knife section 370A on the first wall 304A and the fifth air knife section 370D on the second wall 304B are positionally aligned with each other.

Additionally, various aspects of the disclosure also provide for a dryer system 300 that comprises a plenum 301 configured to receive air from an air source 120. The dryer system 300 comprises a first air knife structure 350 coupled to the plenum 301 and a second air knife structure 360 coupled to the plenum 301. The dryer system 300 further comprises an air inlet 308 on the plenum 301 configured to receive the air from the air source 120 via an air conduit 102.

The plenum 301 is substantially upside-down-U shaped, and the plenum 301 comprises an inner surface 304 and an outer surface 302. The inner surface 304 comprises a first wall 304A and a second wall 304B opposite the first wall 304A. The first air knife structure 350 comprises a first air knife section 350A coupled to the first wall 304A of the plenum 301 and a second air knife section 350B, and the second air knife structure 360 comprises a third air knife section 360A coupled to the second wall 304B of the plenum 301 and a fourth air knife section 360B.

The inner surface 304 comprises a ceiling 304C connecting the first wall 304A and the second wall 304B. The second air knife section 350B is configured to be coupled to the ceiling 304C, and the fourth air knife section 360B is configured to be coupled to the ceiling 304C.

The second air knife section 350B and the fourth air knife section 360B are configured to direct air substantially vertically downward. The first air knife section 350A is configured to direct air substantially horizontally in a direction toward the third air knife section 360A, and the third air knife section 360A is configured to direct air substantially horizontally in a direction toward the first air knife section 350A.

The first air knife section 350A coupled to the first wall 304A and the third air knife section 360A coupled to the second wall 304B are positionally aligned with each other.

Various aspects of the disclosure also provide for the dryer system 300 that comprises a plenum 301 configured to receive air from an air source 120, a first air knife 306 coupled to the plenum 301, a second air knife 320 coupled to the plenum 301, and at least one air nozzle 322 coupled to a ceiling 304C, wherein the ceiling 304C connects a first wall 304A of the plenum 301 to a second wall 304B of the plenum 301, and wherein the second wall 304B is opposite the first wall 304A.

Various aspects of the disclosure also provides for the dryer system 300 that comprises a plenum 301 configured to receive air from an air source 120, a first air knife 306 coupled to the plenum 301, a second air knife 320 coupled to the plenum 301, and a third air knife 323 coupled to a ceiling 304C, wherein the ceiling 304C connects a first wall 304A of the plenum 301 to a second wall 304B of the plenum 301, and wherein the second wall 304B is opposite the first wall 304A.

As utilized herein, "and/or" means any one or more of the items in the list joined by "and/or." As an example, "x and/or y" means any element of the three-element set {(x), (y), (x, y)}. In other words, "x and/or y" means "one or both of x and y". As another example, "x, y, and/or z" means any element of the seven-element set {(x), (y), (z), (x, y), (x, z), (y, z), (x, y, z)}. In other words, "x, y and/or z" means "one or more of x, y and z". As utilized herein, the term "exemplary" means serving as a non-limiting example, instance, or illustration. As utilized herein, the terms "e.g." and "for example" set off lists of one or more non-limiting examples, instances, or illustrations.

While the present method and/or system has been described with reference to certain implementations, it will be understood by those skilled in the art that various changes may be made and equivalents may be substituted without departing from the scope of the present method and/or system. In addition, many modifications may be made to adapt a particular situation or material to the teachings of the present disclosure without departing from its scope. Therefore, the present method and/or system are not limited to the particular implementations disclosed. Instead, the present method and/or system will include all implementations falling within the scope of the appended claims, both literally and under the doctrine of equivalents.

What are claimed:

1. A dryer system, comprising:

a plenum configured to receive air from an air source; and an air knife structure comprising a first air knife section and a second air knife section, wherein:

the plenum comprises an inner surface and an outer surface, the inner surface comprises a first inner wall, a second inner wall, and a ceiling connecting the first inner wall and the second inner wall, the first air knife section is configured to be coupled to at least the first inner wall of the plenum, and the second air knife section is configured to be coupled to at least the second inner wall of the plenum that is opposite to and faces the first inner wall.

2. The dryer system of claim 1, wherein a vertical cross-section of the plenum is substantially upside-down-U shaped.

3. The dryer system of claim 1, wherein the first air knife section comprises a third air knife section configured to be coupled to the first inner wall and a fourth air knife section configured to be coupled to the ceiling, and the second air knife section comprises a fifth air knife section configured to be coupled to the second inner wall and a sixth air knife section configured to be coupled to the ceiling.

4. The dryer system of claim 3, wherein the air knife structure comprises the third air knife section coupled to the fourth air knife section, the fourth air knife section coupled to the sixth air knife section, and the sixth air knife section coupled to the fifth air knife section.

5. The dryer system of claim 3, wherein the fourth air knife section and the sixth air knife section are configured to direct air substantially vertically downward.

6. The dryer system of claim 3, wherein the third air knife section is configured to direct air substantially horizontally in a direction toward the fifth air knife section, and the fifth air knife section is configured to direct air substantially horizontally in a direction toward the third air knife section.

7. The dryer system of claim 3, wherein the third air knife section on the first inner wall and the fifth air knife section on the second inner wall are positionally aligned with each other.

8. The dryer system of claim 1, further comprising an air inlet on the plenum configured to receive the air from the air source via an air conduit.

9. A dryer system, comprising:

a plenum configured to receive air from an air source, wherein:

the plenum comprises an inner surface and an outer surface, and the inner surface comprises a first inner wall and a second inner wall that is opposite to and faces the first inner wall;

a first air knife structure coupled to the first inner wall of the plenum; and a second air knife structure coupled to the second inner wall of the plenum.

10. The dryer system of claim 9, further comprising an air inlet on the plenum configured to receive the air from the air source via an air conduit.

11. The dryer system of claim 9, wherein a vertical cross-section of the plenum is substantially upside-down-U shaped.

12. The dryer system of claim 9, wherein:

the first air knife structure comprises a first air knife section coupled to the first inner wall of the plenum and a second air knife section, and the second air knife structure comprises a third air knife section coupled to the second inner wall of the plenum and a fourth air knife section.

13. The dryer system of claim 12, wherein the inner surface comprises a ceiling connecting the first inner wall and the second inner wall.

14. The dryer system of claim 13, wherein:

the second air knife section is configured to be coupled to the ceiling; and the fourth air knife section is configured to be coupled to the ceiling.

15. The dryer system of claim 14, wherein the second air knife section and the fourth air knife section are configured to direct air substantially vertically downward.

16. The dryer system of claim 12, wherein the first air knife section is configured to direct air substantially horizontally in a direction toward the third air knife section, and the third air knife section is configured to direct air substantially horizontally in a direction toward the first air knife section.

17. The dryer system of claim 12, wherein the first air knife section coupled to the first inner wall and the third air knife section coupled to the second inner wall are positionally aligned with each other.

18. The dryer system of claim 9, further comprising at least one air nozzle coupled to a ceiling, wherein the ceiling connects a first inner wall of the plenum to a second inner wall of the plenum, wherein the second inner wall is opposite the first inner wall.

19. The dryer system of claim 9, further comprising a third air knife structure coupled to a ceiling, wherein the ceiling connects a first inner wall of the plenum to a second inner wall of the plenum, wherein the second inner wall is opposite the first inner wall.

* * * * *